US009776232B2

(12) United States Patent
Hartwig et al.

(10) Patent No.: US 9,776,232 B2
(45) Date of Patent: Oct. 3, 2017

(54) PROCESSING OF HOLLOW SECTIONS

(75) Inventors: Karl T. Hartwig, College Station, TX (US); Robert E. Barber, Bryan, TX (US)

(73) Assignee: Shear Form, Inc., Bryan, TX (US)

( * ) Notice: Subject to any disclaimer, the term of this patent is extended or adjusted under 35 U.S.C. 154(b) by 161 days.

(21) Appl. No.: 13/606,473

(22) Filed: Sep. 7, 2012

(65) Prior Publication Data

US 2013/0239640 A1 Sep. 19, 2013

Related U.S. Application Data

(60) Provisional application No. 61/531,674, filed on Sep. 7, 2011.

(51) Int. Cl.
*B21C 23/00* (2006.01)
*B21C 23/12* (2006.01)

(52) U.S. Cl.
CPC ..... *B21C 23/12* (2013.01); *B21C 23/001* (2013.01)

(58) Field of Classification Search
CPC ..... B21C 23/002; B21C 23/04; B21C 23/18; B21C 23/183; B21C 23/12; B21C 23/001; B21C 23/217
USPC ..... 72/253.1, 264, 266, 268
See application file for complete search history.

(56) References Cited

U.S. PATENT DOCUMENTS 3,798,954 A * 3/1974 Asari ..... B21C 23/085 72/255
5,461,898 A * 10/1995 Lessen ..... 72/256
5,513,512 A * 5/1996 Segal ..... 72/253.1
5,826,456 A * 10/1998 Kawazoe et al. ..... 72/253.1
6,883,359 B1 4/2005 Hartwig, Jr.
6,895,795 B1 * 5/2005 Chaudhury et al. ..... 72/262
6,912,885 B2 * 7/2005 Keener et al. ..... 72/262
(Continued)

FOREIGN PATENT DOCUMENTS

DE 102009050543 B3 * 5/2011
JP 2004174563 A * 6/2004
JP 2007245156 A * 9/2007
(Continued)

OTHER PUBLICATIONS

Espacenet machine translation of JP2004174563 A.*
(Continued)

*Primary Examiner* — James S McClellan
*Assistant Examiner* — Peter Iannuzzi
(74) *Attorney, Agent, or Firm* — Tumey L.L.P.

(57) ABSTRACT

A system and method provide a material with uniform micro-structure. In an embodiment, an equal channel angular extrusion system includes an interior mandrel. The interior mandrel includes an expanding shear material section and a contracting shear material section. In addition, the system includes a material. The material is disposed about a portion of the interior mandrel. Moreover, the system includes a pressure application device. The pressure application device applies pressure to the material to force the material to contact the expanding shear material section to provide an expanded post-shear material section. Pressure from the pressure application device applies pressure to the material to force the expanded post-shear material section to contact the contracting shear material section to provide a contracted shear material section.

17 Claims, 7 Drawing Sheets

(56) References Cited

U.S. PATENT DOCUMENTS

| | | | | |
|---|---|---|---|---|
| 7,191,630 | B2 * | 3/2007 | Segal | B21C 23/01 72/253.1 |
| 2004/0072009 | A1 | 4/2004 | Segal et al. | |

FOREIGN PATENT DOCUMENTS

| | | | |
|---|---|---|---|
| JP | 2007-2451516 | | 9/2009 |
| KR | 20090115471 | A | 11/2009 |
| KR | 20090115471 | A1 * | 11/2009 |
| RU | 2108881 | C1 * | 4/1998 |
| SU | 504574 | A1 * | 2/1976 |

OTHER PUBLICATIONS

Espacenet machine translation of JP2004174563 A; Espacenet machine translation of KR20090115471A1.*
European Examination and Search Report for European Application No. 12 183 459.2 dated Nov. 26, 2014.
Exam Report for European Application No. 12 183 459.2-1702 dated Mar. 14, 2016.
Japanese office action and English translation for Japanese application No. JP2012-196575 dated May 24, 2016.

* cited by examiner

PROCESSING OF HOLLOW SECTIONS

CROSS-REFERENCE TO RELATED APPLICATIONS

This application is a non-provisional application that claims the benefit of U.S. Application Ser. No. 61/531,674 filed on Sep. 7, 2011, which is incorporated by reference herein in its entirety.

STATEMENT REGARDING FEDERALLY SPONSORED RESEARCH OR DEVELOPMENT

This application was made with government support under the DOE grant reference numbers DE-FG02-07ER84916 and DE-SC0004589.

BACKGROUND OF THE INVENTION

Field of the Invention

This invention relates to the field of metal working and more specifically to the field of producing metal sections having uniform properties and uniform structure.

Background of the Invention

Piping and tubing are produced by conventional processes such as casting, extrusion, and strip forming combined with bonding/welding. The main function of piping and tubing is typically to transport material (i.e., a fluid) from one location to another. The material requirements for conventional piping and tubing include strength, leak tightness, and resistance to erosion and chemical attack. Such material requirements for the typical functions are often not demanding or challenging. For instance, the micro-structure of the tubing or piping may not be important. The micro-structure in the pipe or tube may vary from one location to another without serious negative impact.

For instances in which the mechanical requirements for piping and tubing during operations are significant, the micro-structure of the piping and tubing material may often need sufficient characteristics. As an example, the characteristics may include a sufficiently small grain size. The sufficient characteristics may also include sufficiently uniform or consistent micro-structure. Such characteristics may be desired to provide an expected performance during subsequent forming and operation. Significant mechanical requirements may be needed when tubing or piping carry fluid under high pressure or may be formed into another shape (i.e., by hydro-forming). If the tubing or piping contain regions with inferior properties, the operating conditions may be limited by the weak link properties (i.e., characteristics), and forming or operational characteristics may be degraded. Such inferior properties may include those in or near a weld. Both of these factors may influence cost effectiveness. In many cases, the micro-structure across the thickness of the tube wall is non-uniform. Such non-uniformity may result from manufacturing conditions. For instance, in cast metal pipe, the grain size may be smaller near the outside and inside tube wall surfaces. Drawbacks to the non-uniformity may negatively impact tube performance and thus overall cost.

Consequently, there is a need for improved processes for producing tubing and piping. Further needs include improved methods for producing uniform and consistent micro-structures in hollow sections of material.

BRIEF SUMMARY OF SOME OF THE PREFERRED EMBODIMENTS

These and other needs in the art are addressed in one embodiment by an equal channel angular extrusion system.

The system includes an interior mandrel. The interior mandrel has an expanding shear material section and a contracting shear material section. In addition, the system includes a material. The material is disposed about a portion of the interior mandrel. Moreover, the system includes a pressure application device. The pressure application device applies pressure to the material to force the material to contact the expanding shear material section to provide an expanded post-shear material section. Pressure from the pressure application device applies pressure to the material to force the expanded post-shear material section to contact the contracting shear material section to provide a contracted shear material section.

These and other needs in the art are addressed in another embodiment by a method for applying severe plastic deformation to a material to provide the material with substantially uniform micro-structure. The method includes disposing the material about a portion of an interior mandrel. The method further includes expanding the material to provide an expanded post-shear material section. In addition, the method includes contracting the expanded post-shear material section to provide a contracted shear material section. The contracted shear material section has substantially uniform micro-structure. The contracted shear section also has substantially uniform micro-structure.

In addition, these and other needs in the art are addressed in an embodiment by an equal channel angular extrusion system. The system includes a mandrel. The mandrel includes a mandrel pre-shear zone section and a mandrel post-shear zone section. The mandrel post-shear zone section is at an angle to the mandrel pre-shear zone section. The mandrel further includes a shear zone at the intersection of the mandrel pre-shear zone section and the mandrel post-shear zone section. The system also includes a material. Moreover, the system includes a pressure application device. The pressure application device applies pressure to the material to force the material to pass through the shear zone. Severe plastic deformation is applied to the material in the shear zone.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
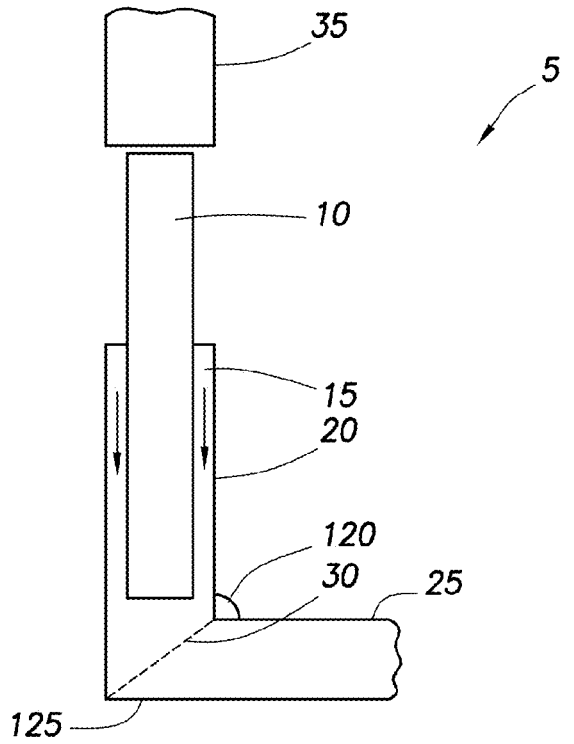
FIG. 1 illustrates a side cross sectional view of an embodiment of an equal channel angular extrusion system in which the material has not reached the shear zone.
Figure 3:
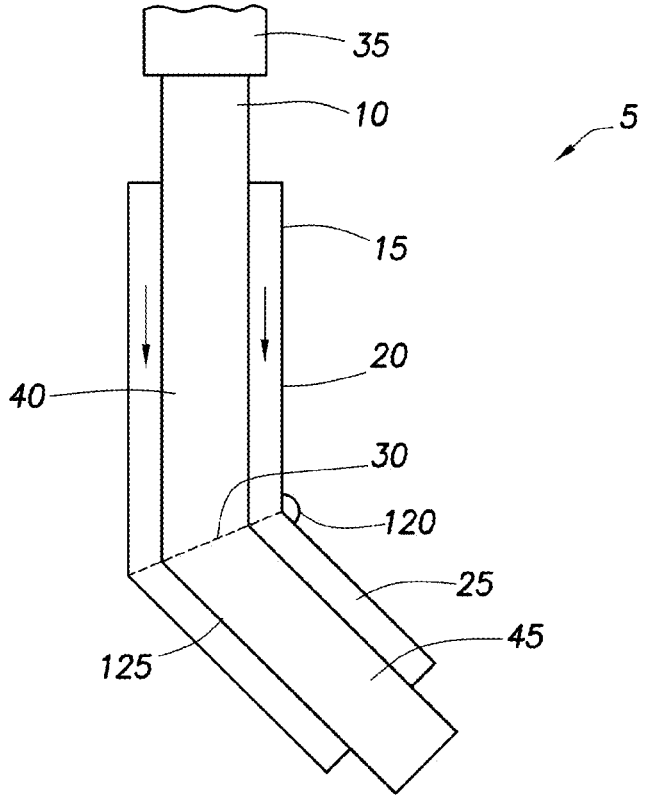
FIG. 3 illustrates a side cross sectional view of an embodiment of an equal channel angular extrusion system with the material passing through the shear zone.
Figure 2:
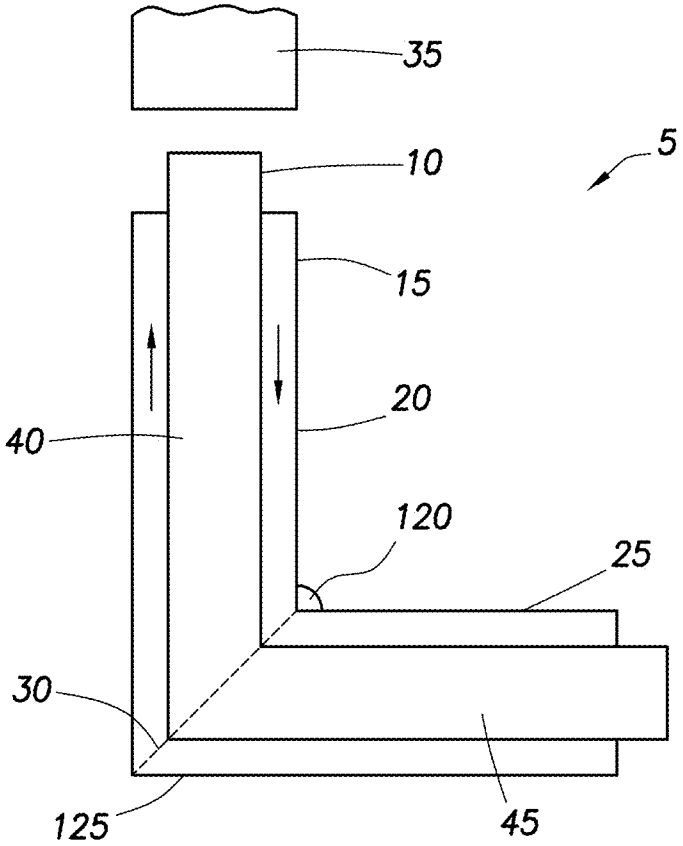
FIG. 2 illustrates a side cross sectional view of an embodiment of an equal channel angular extrusion system with the material passing through the shear zone.

FIGS. 1, 2, and 3 illustrate an embodiment of equal channel angular extrusion system 5 having material 10, mandrel 15, and pressure application device 35. Equal channel angular extrusion system 5 provides severe plastic deformation to material 10. In embodiments, material 10 has micro-structural non-uniformities prior to application of equal channel angular extrusion system 5 to material 10. Without limitation, equal channel angular extrusion system 5 transforms the micro-structural non-uniformities to a uniform micro-structure. It is to be understood that a uniform micro-structure refers to a micro-structure that has substantially the same properties and structure throughout the material 10. The uniform micro-structure may be circumferentially symmetric micro-structure and may be substantially uniform through the thickness. Further, without limitation, the severe plastic deformation of equal channel angular extrusion system 5 provides a uniform plastic strain throughout material 10, which provides the uniform micro-structure in material 10. In addition, without limitation, equal channel angular extrusion system 5 provides control over the resulting texture of material 10 after material 10 is processed by equal channel angular extrusion system 5. In embodiments, the texture is controlled by the strain path applied to material 10. Further, without limitation, equal channel angular extrusion system 5 may homogenize (i.e., make uniform) non-uniform micro-structures in hollow sections without a change in part geometry.

FIG. 1 shows material 10 before it passes through shear zone 30. FIGS. 2 and 3 show embodiments in which a portion of material 10 has passed through shear zone 30. In such embodiments, pre-shear material section 40 is the portion of material 10 that has not passed through shear zone 30 (noted in the Figures with a dashed line for illustrative purposes only), and post-shear material section 45 is the portion of material 10 that has passed through shear zone 30.

Material 10 may be any material suitable for severe plastic deformation. In embodiments, material 10 is metal. In some embodiments, the metal is a transition metal, metal alloys, or any combinations thereof. For instance, an embodiment includes the metal comprising niobium. In another embodiment, the metal is tantalum. Material 10 may have any desired configuration. For instance, material 10 may be hollow or solid. Material 10 may have a circular shaped cross section, a hexagonal cross section, an octagonal cross section, a square shaped cross section, and the like. Without limitation, examples of material 10 include piping, bar, tubing, plate, hollow plate, and the like. In some embodiments, shear zone 30 is between about 1% and about 10% of the diameter of material 10.

Mandrel 15 has mandrel pre-shear zone section 20, mandrel post-shear zone section 25, and shear zone 30. In embodiments as shown, mandrel 15 is hollow. Mandrel pre-shear zone section 20 is at angle 120 with mandrel post-shear zone section 25. Angle 120 may be any angle suitable for severe plastic deformation of material 10. In embodiments, angle 120 is between about 90 degrees and about 180 degrees, alternatively angle 120 is between about 90 degrees and about 150 degrees. In an embodiment, angle 120 is about 90 degrees. In the embodiments of equal channel angular extrusion system 5 shown in FIGS. 1 and 2, angle 120 is about 90 degrees. In the embodiment of equal channel angular extrusion system 5 shown in FIG. 3, angle 120 is about 135 degrees.

As shown in FIGS. 1, 2, and 3, angle 120 provides shear zone 30. Shear zone 30 is a location in which simple shear is applied to material 10 as material 10 passes from mandrel pre-shear zone section 20 to mandrel post-shear zone section 25. Shear zone 30 extends laterally across mandrel 15 at the intersection of mandrel pre-shear zone section 20 and mandrel post-shear zone section 25.

In addition, as shown in FIGS. 1, 2, and 3, pressure application device 35 is any device that supplies sufficient pressure to material 10 to force material 10 through mandrel 15. In embodiments, pressure application device 35 is a hydraulic ram, piston, and the like. In an embodiment, pressure application device 35 is a hydraulic ram.

In embodiments, material 10 is lubricated by lubricant. In an embodiment, the exterior of material 10 is lubricated prior to disposition in mandrel 15. Any lubricant suitable for reducing friction between material 10 and mandrel 15 may be used. The lubricant may be liquid lubricant, dry lubricant, or any combinations thereof. Liquid lubricant includes oil-based lubricants. Without limitation, examples of suitable oil-based lubricants include petroleum fractions, vegetable oils, synthetic liquids, or any combinations thereof. In addition, without limitation, examples of synthetic liquids include silicones, fluorocarbons, or any combinations thereof. Dry lubricant includes graphite, disulfides such as tungsten disulfide and molybdenum, or any combinations thereof. The lubricant may be applied to material 10 by any suitable method. Without limitation, examples of suitable methods by which lubricant is applied to material 10 include spraying, dipping, brushing, or any combinations thereof.

Figure 10:
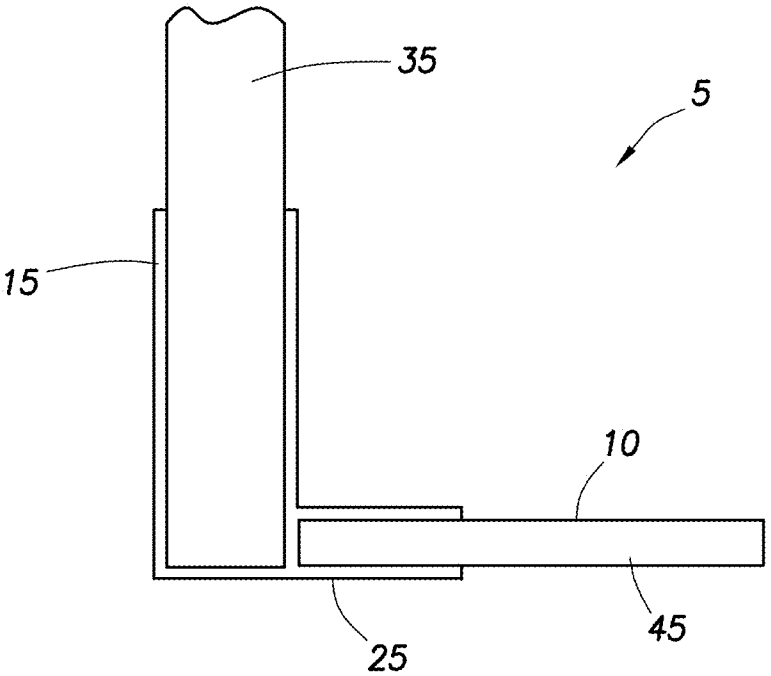
FIG. 10 illustrates an embodiment of an equal channel angular extrusion system after all of the material has passed through the shear section.

In an embodiment of operation of the embodiments shown in FIGS. 1, 2, and 3, material 10 is lubricated and heated. Material 10 may be heated and lubricated in any suitable order. In embodiments, material 10 is lubricated prior to heating. Material 10 may be heated to any temperature suitable to increase the ductility of material 10 as it passes through mandrel 15. In alternative embodiments, material 10 is not heated before passing through mandrel 15. After lubrication and heating, a portion or all of material 10 is disposed in mandrel pre-shear zone section 20. The arrows are representative of the direction of motion of material 10 in mandrel pre-shear zone section 20. Material 10 is pushed through mandrel pre-shear zone section 20 until it contacts mandrel 15 wall at shear contact area 125. At shear contact area 125, the pressure applied to material 15 by pressure application device 35 forces simple shear upon material 10 as it passes through shear zone 30. The simple shear provides severe plastic deformation to pre-shear material section 40 to provide post-shear material section 45. Pressure is applied by pressure application device 35 until all of pre-shear material section 40 has passed through shear zone 30. FIG. 10 illustrates an embodiment of equal channel angular extrusion system 5 in which all of material 10 has passed through shear zone 30. Material 10 may then be removed from mandrel 15. In some embodiments, mandrel 15 is secured during the pressure application. In such embodiments, mandrel 15 is sufficiently secured to prevent movement of mandrel 15 during the pressure application. The resultant material 10 after removal from mandrel 15 has about the same dimensions (i.e., about the same width and height) as it did prior to disposition in mandrel 15. In embodiments, material 10 is passed more than one time through mandrel 15. In an embodiment, material 10 is passed multiple times through mandrel 15. In embodiments, material 10 is passed through mandrel 15 a sufficient amount of times until a desired uniform micro-structure in material 10 is achieved. Without limitation, each pass of material 10 through mandrel 15 improves the uniform micro-structure in material 10. In some embodiments, lubrication is added prior to disposition in mandrel 15 as desired when material 10 is passed through mandrel 15 multiple times. In alternative embodiments (not illustrated), mandrel 15 has more than one shear zone 30 and/or more than one angle 120.

In some embodiments, equal channel angular extrusion system 5 includes applying a post-deformation heat treatment to material 10 after the desired number of passes through mandrel 15 has been achieved. The heat may be applied by any suitable method. Without limitation, the post-deformation heat treatment may include any suitable temperature and duration to achieve the desired recovery, recrystallization, softening, or grain refinement of the micro-structure.

In an embodiment, equal channel angular extrusion system 5 includes drawing material 10 after the desired number of passes through mandrel 15 has been achieved. The drawing may be accomplished before and/or after the heat treatment. Without limitation, the drawing may adjust the diameter and/or length of mandrel 15.

Figure 11:
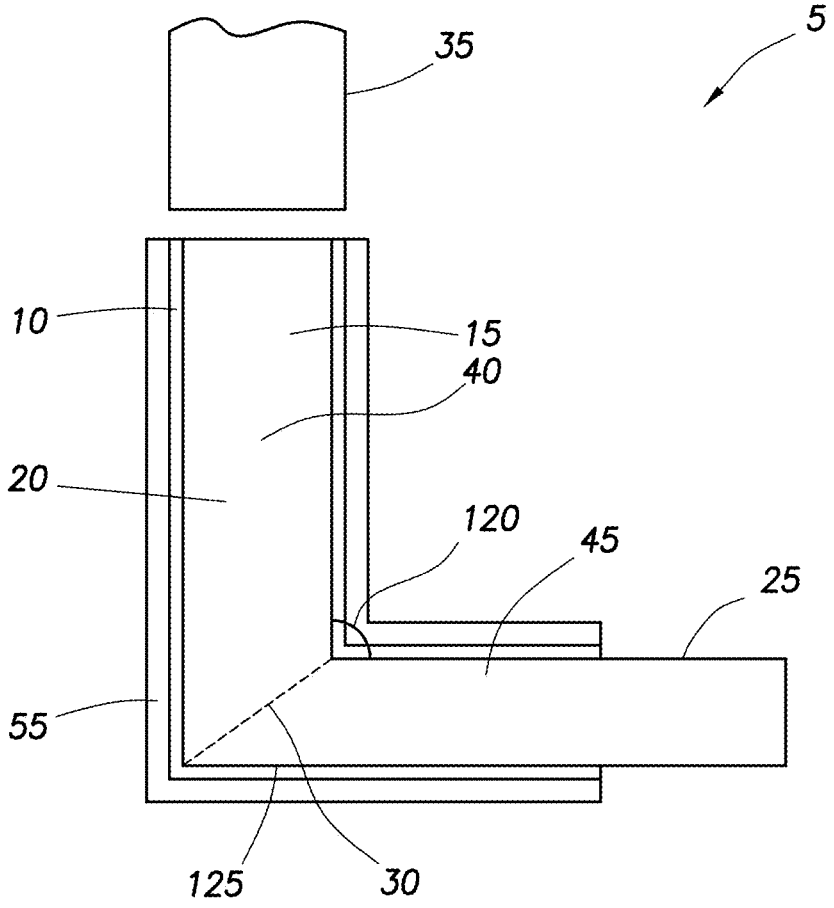
FIG. 11 illustrates an embodiment of an equal channel angular extrusion system in which the material is pressed over the mandrel.

FIG. 11 illustrates an alternative embodiment of equal channel angular extrusion system 5 in which material 10 is pressed by pressure application device 35 over mandrel 15. In such embodiment, material 10 is hollow.

Figure 4A:
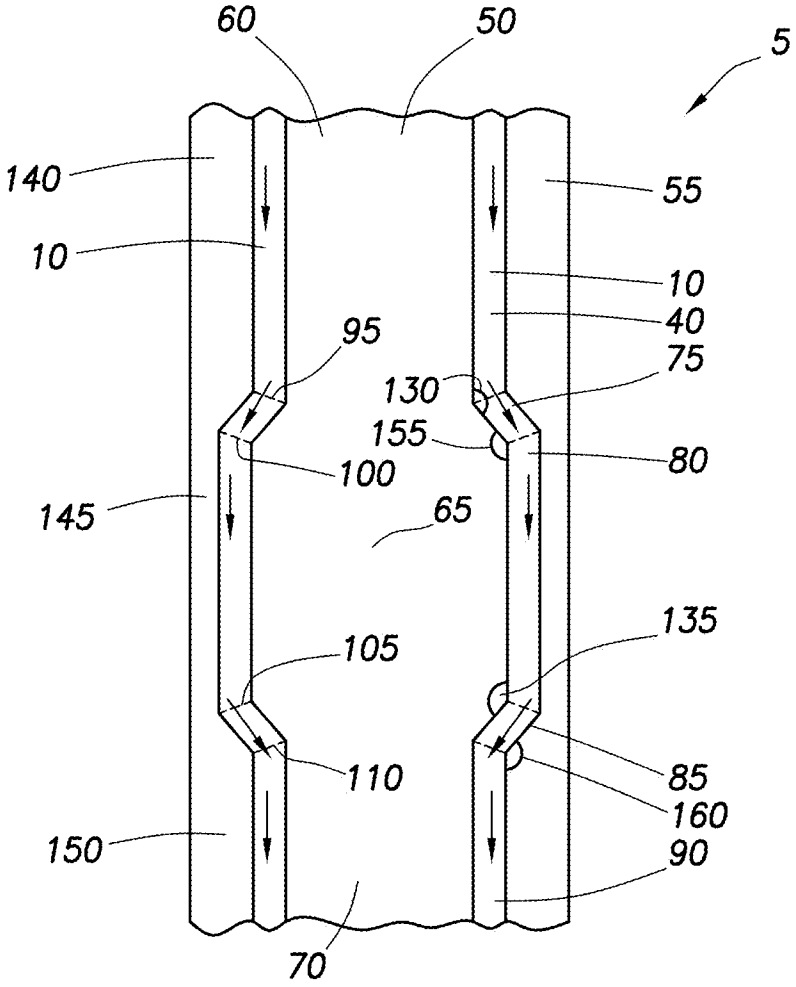
FIG. 4*a*) illustrates a side cross sectional view of an embodiment of an equal channel angular extrusion system in which the material is expanded and contracted.
Figure 4C:
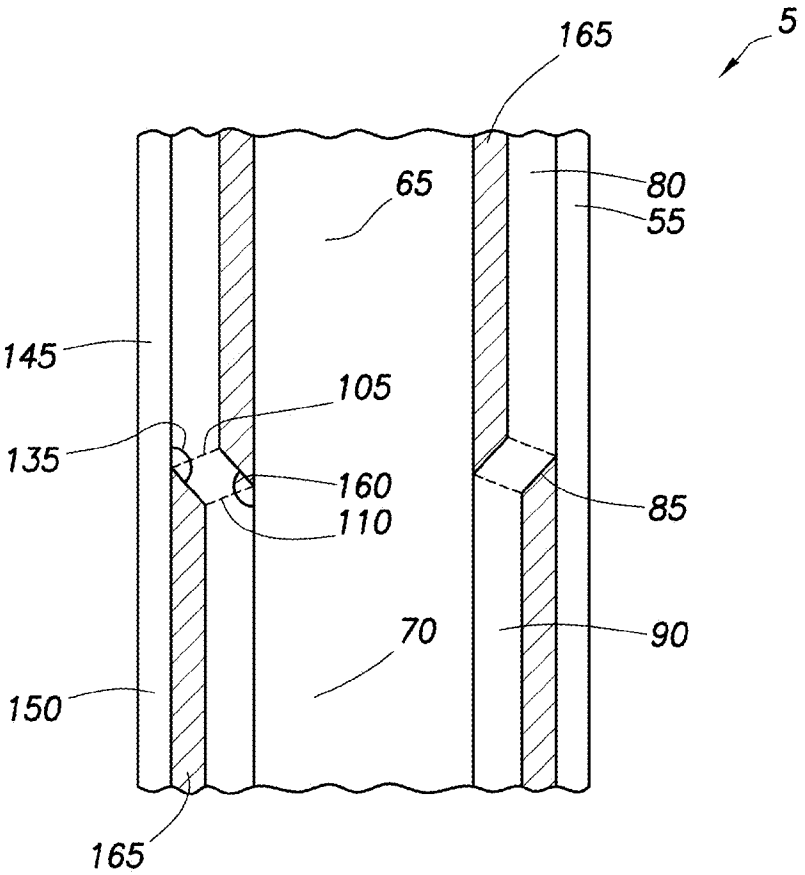
FIG. 4*c*) illustrates a side cross sectional view of an embodiment of an equal channel angular extrusion system in which the material is contracted.
Figure 4B:
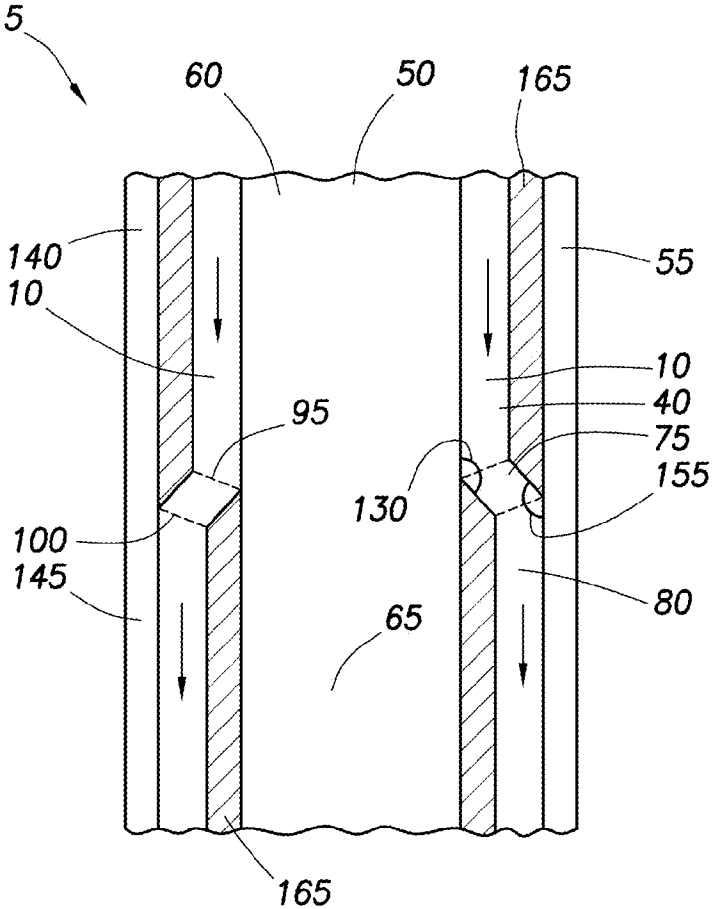
FIG. 4*b*) illustrates a side cross sectional view of an embodiment of an equal channel angular extrusion system in which the material is expanded.

FIG. 4*a*) illustrates a portion of an embodiment of an equal channel angular extrusion system 5 having material 10 pressed over the exterior of interior mandrel 50. In such embodiment, material 10 is hollow. It is to be understood that pressure application device 35 is not shown for illustrative purposes only. It is to be further understood that the arrows represent the direction of movement of material 10. In such embodiment, interior mandrel 50 has expanding angle 130, second expanding angle 155, contracting angle 135, second contracting angle 160, interior mandrel pre-shear zone section 60, interior mandrel post-shear expanded zone section 65, and interior mandrel post-shear contracted zone section 70. In embodiments, interior mandrel pre-shear zone section 60 has about the same diameter as interior mandrel post-shear contracted zone section 70. Expanding angle 130, second expanding angle 155, contracting angle 135, and second contracting angle 160 may be any angles suitable for severe plastic deformation of material 10. In embodiments, expanding angle 130, second expanding angle 155, contracting angle 135, and second contracting angle 160 may each be between about 90 degrees and about 180 degrees, alternatively each between about 90 degrees and about 150 degrees. In an embodiment, expanding angle 130, second expanding angle 155, contracting angle 135, and/or second contracting angle 160 are each about 90 degrees. In an embodiment as shown, equal channel angular extrusion system 5 has wall 55 with material 10 disposed between interior mandrel 50 and wall 55. In embodiments, wall 55 has a similar configuration to material 10. In an embodiment, wall 55 has wall pre-shear zone section 140, wall post-shear expanded zone section 145, and wall post-shear contracted zone section 150. In some embodiments, wall 55 expands along with expansion of material 10. In embodiments as shown in FIGS. 4*b*) and 4*c*), wall 55 is a sliding wall. In such embodiments, wall 55 moves along with material 10 by pressure applied from pressure application device 35. In such embodiments, equal channel angular extrusion system 5 has fixed pieces 165. Such fixed pieces do not move in relation to material 10. In such embodiments, interior mandrel 50 also slides along with material 10 and wall 55. In alternative embodiments (not illustrated), equal channel angular extrusion system 5 does not have a wall 55.

Figure 5:
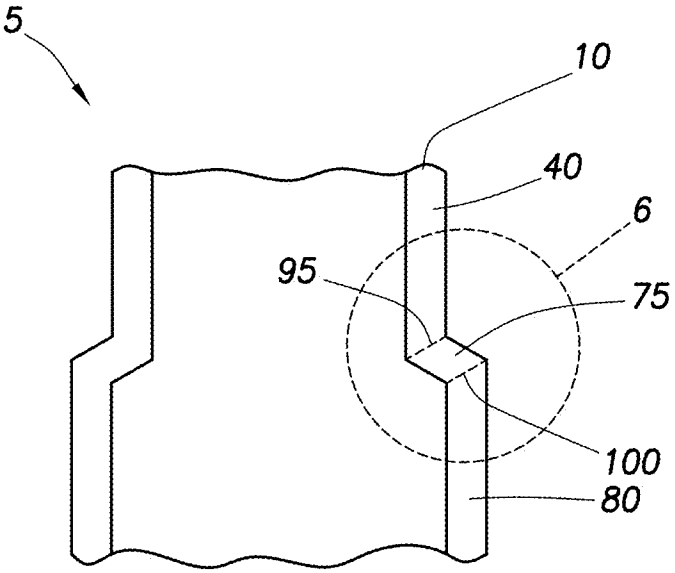
FIG. 5 illustrates a side cross sectional view of an embodiment of an expanding shear material section.

In operation of an embodiment as shown in FIGS. 4*b*), 4*c*), and 5, material 10 is pressed over the exterior of interior mandrel 50 with pre-shear material section 40 of material 10 passing along the exterior of interior mandrel pre-shear zone section 60. FIG. 5 illustrates an embodiment of a section of equal channel angular extrusion system 5 including expanding shear material section 75. In embodiments, material 10 is lubricated and/or pre-heated. Wall 55 and interior mandrel 50 move along correspondingly with material 10. In embodiments, wall pre-shear zone section 140 moves correspondingly in parallel with pre-shear material section 40 by pressure applied by pressure application device 35 (not shown). When the non-expanded section of material 10 (pre-shear material section 40) contacts expanding shear material section 75 of interior mandrel 50, material 10 continues sliding with material 10 expanding at about the expanding angle 130. Expanding shear material section 75 has first shear expansion zone 95 and second shear expansion zone 100. First shear expansion zone 95 and second shear expansion zone 100 (noted with the dashed lines on FIG. 4 for illustrative purposes only) are locations in which simple shear is applied to material 10 as material 10 passes from interior mandrel pre-shear zone section 60 to interior mandrel post-shear expanded zone section 65. The simple shear provided by first shear expansion zone 95 and second shear expansion zone 100 applies severe plastic deformation to material 10. In embodiments, first shear expansion zone 95 extends across material 10 at about the expanding angle 130, and second shear expansion zone 100 extends across material 10 at about the second expanding angle 155. The area from first shear expansion zone 95 to second shear expansion zone 100 is the expanding shear material section 75.

In embodiments as further shown in FIGS. 4*b*), 4*c*), and 5, after expanding shear material section 75 expands material 10, material 10 continues to move (i.e., slide) with the expanded portion of material 10 (expanded post-shear material section 80) moving along the exterior of interior mandrel post-shear expanded zone section 65. In embodiments, interior mandrel post-shear expanded zone section 65 does not expand (i.e., is not at an angle to expanded post-shear material section 80) expanded post-shear material section 80. In embodiments, expanded post-shear material section 80 has a larger diameter than pre-shear material section 40. In some embodiments, post-shear material section 80 has an interior diameter that is about the same as the exterior diameter of pre-shear material section 40. Wall 55 and interior mandrel 50 move along correspondingly with material 10. In an embodiment, wall 55 and interior mandrel 50 move in parallel with the material 10. In embodiments, wall post-shear expanded zone section 145 moves correspondingly in parallel with expanded post-shear material section 80 by pressure applied by pressure application device 35 to the opposing ends of interior mandrel pre-shear zone section 60 and wall pre-shear zone section 140 from expanding shear material section 75. After material 10 has been expanded, it is removed and may then be contracted, which is shown in FIG. 4*c*).

In further embodiments as shown in FIGS. 4*b*), 4*c*), and 7, when the expanded post-shear section of material 10 contacts contracting shear material section 85 of interior mandrel 50, material 10 continues sliding with material 10 contracting at about the contracting angle 135. Contracting shear material section 85 has first shear contraction zone 105 and second shear contraction zone 110. First shear contraction zone 105 and second shear contraction zone 110 (noted with the dashed lines on FIG. 4 for illustrative purposes only) are locations in which simple shear is applied to material 10 as material 10 passes from interior mandrel post-shear expanded zone section 65 to interior mandrel post-shear contracted zone section 70. The simple shear provided by first shear contraction zone 105 and second shear contraction zone 110 applies severe plastic deformation on material 10. In embodiments, first shear contraction zone 105 extends across material 10 at about the contracting angle 135, and second shear contraction zone 110 extends across material 10 at about the second contracting angle 160. The area from first shear contraction zone 105 to second shear contraction zone 110 is the contracting shear material section 85.

Figure 7:
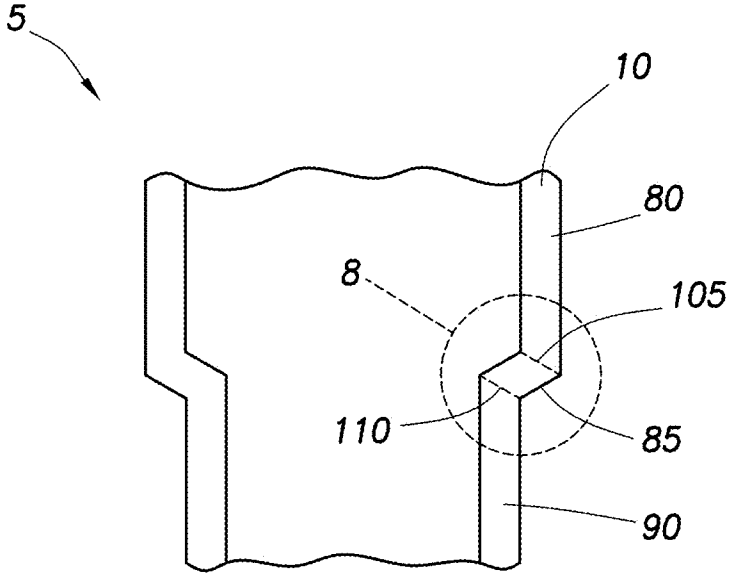
FIG. 7 illustrates a side cross sectional view of an embodiment of a contracting shear material section.

In embodiments as further shown in FIGS. 4 and 7, after contracting shear material section 85 contracts material 10, material 10 continues to move (i.e., slide) with the contracted portion of material 10 (contracted shear material section 90) moving along the exterior of interior mandrel post-shear contracted zone section 70. In embodiments, interior mandrel post-shear contracted zone section 70 does not expand (i.e., is not at an angle to contracted shear material section 90) contracted shear material section 90. In embodiments, contracted shear material section 90 has a smaller diameter than expanded shear material section 80. In some embodiments, contracted shear material section 90 has about the same diameter as pre-shear material section 40. Wall 55 and interior mandrel 50 move along correspondingly with material 10. In embodiments, wall post-shear contracted zone section 150 moves correspondingly in parallel with contracted shear material section 90 by pressure applied by pressure application device 35 to the opposing ends of interior mandrel pre-shear zone section 60 and wall pre-shear zone section 140 from expanding shear material section 75.

In alternative embodiments (not illustrated), material 10 is contracted and then expanded back to about its original dimensions.

Without limitation, wall 55 and interior mandrel 50 sliding along with material 10 may reduce friction. Further, without limitation, wall 55 and interior mandrel 50 sliding along with material 10 may also facilitate the movement of material 10.

In embodiments, material 10 is passed more than one time over interior mandrel 50. In an embodiment, material 10 is passed multiple times over interior mandrel 50. In embodiments, material 10 is passed over interior mandrel 50 a sufficient number of times until a desired uniform micro-structure in material 10 is achieved. Without limitation, each pass of material 10 over interior mandrel 50 improves the uniform micro-structure in material 10. In some embodiments, lubrication is added prior to disposition over interior mandrel pre-shear zone section 60 as desired when material 10 is passed over interior mandrel 50 multiple times. In alternative embodiments (not illustrated), interior mandrel 50 has more than one expanding shear material section 75 and/or more than one contracting shear material section 85. In some embodiments, the desired uniform micro-structure is substantially uniform micro-structure.

FIG. 4*a*) illustrates an embodiment of equal channel angular extrusion system 5 in which wall 55 does not slide along with material 10. In such embodiments as shown, equal channel angular extrusion system 5 has contraction and expansion in the same device. In alternative embodiments (not illustrated), wall 55 and interior mandrel 50 do not slide, and the expansion and contraction are conducted in separate devices, similar to the sliding wall 55 embodiments of FIGS. 4*b*), 4*c*).

In some embodiments, equal channel angular extrusion system 5 includes applying a post-deformation heat treatment to material 10 after the desired number of passes over interior mandrel 50 has been achieved. In an embodiment, equal channel angular extrusion system 5 includes drawing material 10 after the desired number of passes over interior mandrel 50 has been achieved.

Figure 6:
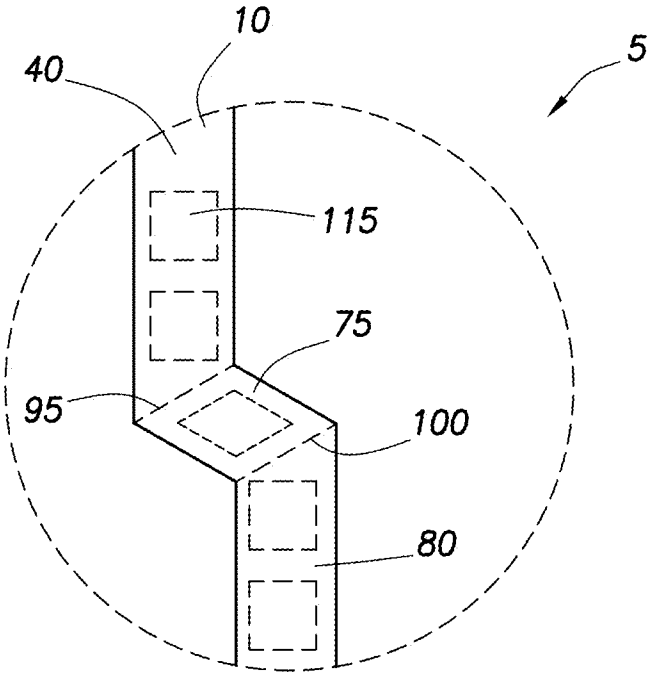
FIG. 6 illustrates an embodiment of representative volume elements.
Figure 8:
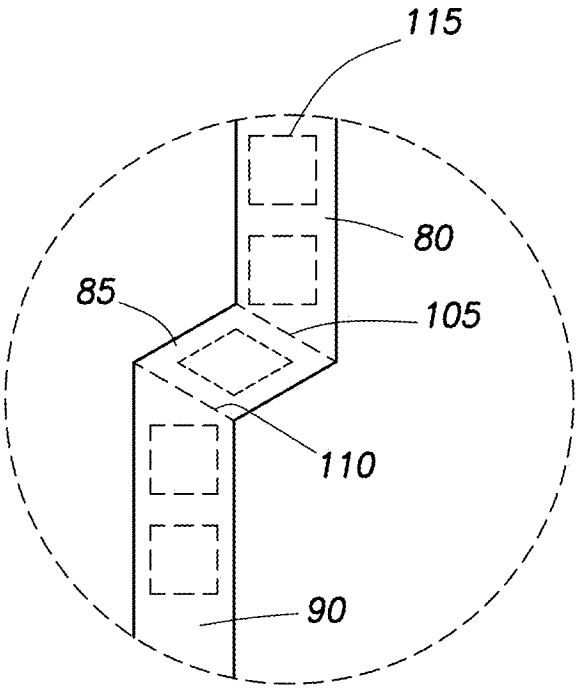
FIG. 8 illustrates an embodiment of representative volume elements.

FIG. 6 illustrates a section of equal channel angular extrusion system 5 including expanding shear material section 75 taken from the illustrative circle on FIG. 5, and FIG. 8 illustrates a section of equal channel angular extrusion system 5 including contracting shear material section 85 taken from the illustrative circle on FIG. 7. The circles on FIGS. 5, 6, 7, and 8 are for illustrative purposes only and do not represent a structural element. In the embodiments illustrated in FIGS. 6 and 8, representative volume elements 115 are shown for illustrative purposes only to show the effects of contraction and expansion on elements of material 10.

Figure 9:
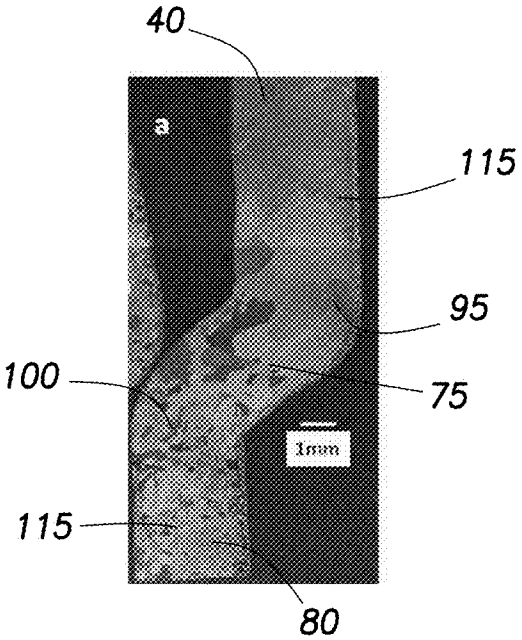
FIG. 9 illustrates an image of an embodiment of representative volume elements.

In embodiments, material 10 may include any type of volume elements (i.e., material volume elements) such as welds, irregularities, cracks, and the like, which provide irregularities in the micro-structure of material 10. Through severe plastic deformation of such representative volume elements 115, equal channel angular extrusion system 5 provides a substantially uniform micro-structure throughout material 10. FIG. 9 illustrates a cross sectional view of an equal channel angular extrusion system 5. As shown, volume elements 115 comprise larger grains prior to expansion at expanding shear material section 75 than in expanded post-shear material section 80.

In an embodiment, an example of an application of equal channel angular extrusion system 5 includes high-RRR pure niobium (Nb) tubing formed into superconducting radio frequency (SRF) cavities. In embodiments, high-RRR pure niobium tubing is material 10. Applying equal channel angular extrusion system 5 to high-RRR pure niobium tubing provides a product (SRF cavities) with uniform and consistent micro-structure. In embodiments, the SRF cavities may be used in charged particle accelerators made up of many cavity strings joined end to end. Without limitation, it may be desired for the tubes formed into cavity strings to have a consistent micro-structure so that the cavities have consistent geometry after forming into an SRG cavity shape. In embodiments, such tubing may have a texture especially suitable for expansion to SRF cavity geometries.

Although the present invention and its advantages have been described in detail, it should be understood that various changes, substitutions and alterations may be made herein without departing from the spirit and scope of the invention as defined by the appended claims.

What is claimed is:

1. An equal channel angular extrusion system, comprising:

an interior mandrel, wherein the interior mandrel comprises an expanding shear material section and a contracting shear material section and wherein the interior mandrel slides;

a material, wherein the material is disposed about a portion of the interior mandrel;

a wall, wherein the wall slides with the material and contacts an entire circumference of the material disposed within a wall pre-shear zone section, a wall post-shear expanded zone section, and a wall post-shear contracted zone section; and a pressure application device, wherein the pressure application device applies pressure to the material to force the material to contact the expanding shear material section to provide an expanded post-shear material section, and wherein pressure from the pressure application device applies pressure to the material to force the expanded post-shear material section to contact the contracting shear material section to provide a contracted shear material section.

2. The equal channel angular extrusion system of claim 1, wherein the expanding shear material section comprises a first shear expansion zone and a second shear expansion zone.

3. The equal channel angular extrusion system of claim 1, wherein the expanding shear material section comprises an expanding angle and a second expanding angle.

4. The equal channel angular extrusion system of claim 1, wherein the contracting shear material section comprises a first shear contraction zone and a second shear contraction zone.

5. The equal channel angular extrusion system of claim 1, wherein the contracting shear material section comprises a contracting angle and a second contracting angle.

6. The equal channel angular extrusion system of claim 1, wherein the portion of the interior mandrel comprises an interior mandrel pre-shear zone section.

7. The equal channel angular extrusion system of claim 6, wherein the interior mandrel further comprises an interior mandrel post-shear expanded zone section disposed between the expanding shear material section and the contracting shear material section.

8. The equal channel angular extrusion system of claim 7, wherein the interior mandrel further comprises an interior mandrel post-shear contracted zone section, and wherein the contracting shear material section is disposed between the interior mandrel post-shear contracted zone section and the interior mandrel post-shear expanded zone section.

9. The equal channel angular extrusion system of claim 8, wherein the interior mandrel post-shear contracted zone section has about the same diameter as the interior mandrel pre-shear zone section.

10. The equal channel angular extrusion system of claim 1, wherein the wall moves in parallel with the material.

11. The equal channel angular extrusion system of claim 1, wherein the material comprises a lubricant.

12. The equal channel angular extrusion system of claim 1, wherein the material is heated prior to being disposed about the portion of the interior mandrel.

13. The equal channel angular extrusion system of claim 1, wherein the pressure application device continues to apply pressure until substantially all of the material comprises the contracted shear material section.

14. The equal channel angular extrusion system of claim 1, wherein the contracted shear material section comprises a substantially uniform micro-structure.

15. A method for applying severe plastic deformation to a material to provide the material with substantially uniform micro-structure, comprises:

(A) disposing the material between a portion of an interior mandrel that slides with the material and a portion of a wall that slides with the material, wherein the wall contacts an entire circumference of the material disposed within a wall pre-shear zone section, a wall post-shear expanded zone section, and a wall post-shear contracted zone section;

(B) expanding the material to provide an expanded post-shear material section;

(C) contracting the expanded post-shear material section to provide a contracted shear material section, wherein the contracted shear material section comprises substantially uniform micro-structure.

16. The method of claim 15, wherein the expanding comprises contacting the material with an expanding shear material section.

17. The method of claim 15, wherein the contracting comprises contacting the material with a contracting shear material section.

* * * * *